United States Patent [19]

Weidner

[11] 4,034,986

[45] July 12, 1977

[54] GAME INVOLVING ESTIMATION OF SPATIAL RELATIONSHIPS

[76] Inventor: W. Robert Weidner, Whaley Lake, Holmes, N.Y. 12531

[21] Appl. No.: 647,888

[22] Filed: Jan. 9, 1976

[51] Int. Cl.[2] ..... A63F 3/00

[52] U.S. Cl. ..... 273/134 B; 35/31 R; 35/34; 273/134 AD; 273/134 C; 273/134 D

[58] Field of Search ..... 35/1, 31; 273/1, 134

[56] References Cited

U.S. PATENT DOCUMENTS

| | | | |
|---|---|---|---|
| 1,471,437 | 10/1923 | Wood | 273/130 R UX |
| 3,104,106 | 9/1963 | Kenney et al. | 273/134 G UX |
| 3,424,455 | 1/1969 | Dunson | 273/1 R |
| 3,815,918 | 6/1974 | Norvich | 273/130 R |
| 3,879,041 | 4/1975 | Hester | 273/130 R |

*Primary Examiner*—Delbert B. Lowe

[57] ABSTRACT

A board game involving the establishment of spatial relationships and measurement thereof to determine the correctness of the estimation. The establishment of a spatial relationship is accomplished by moving a marker along a rectilinear element and/or moving a marker about the center of a circular element to establish, respectively, or alternatively, a spatial relationship between an end of the rectilinear element and the first-mentioned marker and/or the angle made by the marker about the axis of the circular element with reference to, for instance, a radial line extending from the center of the circular element. Alternative ways of playing the game are disclosed. A board having the rectilinear and circular elements may provide marked areas around the periphery thereof which are imprinted with indicia directing the players to estimate a length or an angle preset on the elements with the markers and of which there may be a plurality. Dice may be used, as an element of chance, to direct a player to move a player piece from a starting marked area along the board periphery to another marked area or a number of marked areas from the starting marked area indicated by the number of dots on the die or dice he has thrown. Alternatively, cards, turned face down, may be used and picked by a player, such cards requiring the player to set an angle within the circular element and marker, or to set a rectilinear spatial relationship with the rectilinear element and marker, by estimating where the markers should be placed. In either event, the actual spatial relationship set on the element with the marker is measured by a ruler or a protractor to determine the correctness, or near-correctness, of the player's estimate.

11 Claims, 4 Drawing Figures

Fig.2.
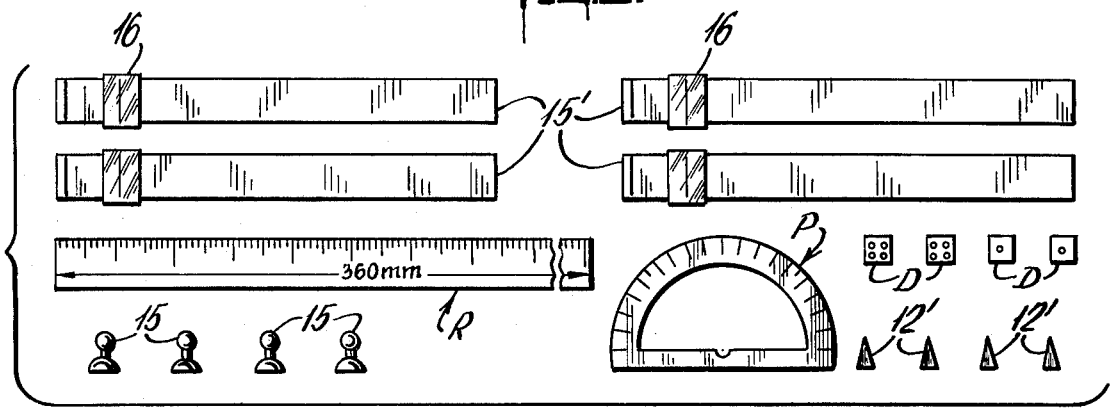
Fig.3.
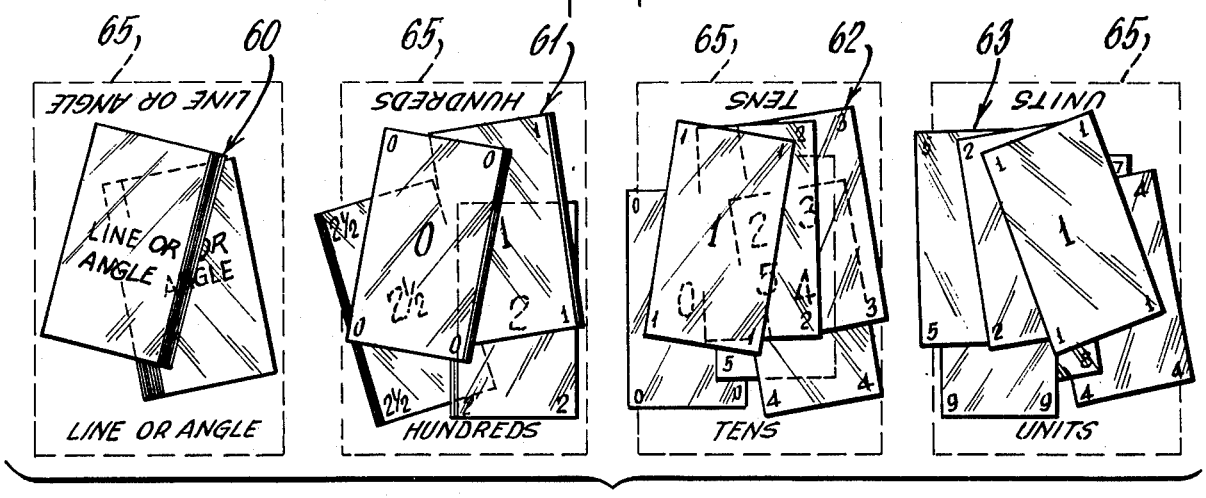
Fig.4.
| | ESTIMATE IN DEGREES OR MILLIMETERS | ACTUAL MEASUREMENT | DIFFERENCE |
|---|---|---|---|
| LINE NO.1 | | | |
| ANGLE NO.1 | | | |
| LINE NO.2 | | | |
| ANGLE NO.2 | | | |
| LINE NO.3 | | | |
| ANGLE NO.3 | | | |
| LINE NO.4 | | | |
| ANGLE NO.4 | | | |
| DIFFERENCE BETWEEN LINE NO.1 & ANGLE NO.1 | | | |
| DIFFERENCE BETWEEN LINE NO.2 & ANGLE NO.2 | | | |
| DIFFERENCE BETWEEN LINE NO.3 & ANGLE NO.3 | | | |
| DIFFERENCE BETWEEN LINE NO.4 & ANGLE NO.4 | | | |
| YOUR SCORE IS TOTAL DIFFERENCE | | | |

GAME INVOLVING ESTIMATION OF SPATIAL RELATIONSHIPS

The present invention, therefore, relates to a game, which may be of the board type, but which, as will be understood, can be played within the format of a television show, for instance, or of a card game type on a card table, so long as the implements necessary for estimating distances and/or angles are present and means are provided for the players to determine the distances and/or angles which have been set or which are to be set.

The objects of the invention are to provide a game, which can be played purely for fun, or which can be utilized in teaching, for instance, arithmetical values of spatial relationships, and further, such values as expressed in the metric system of measurement.

The basic game may provide at least one rectilinear element, whether it be a marking on a game board or a straight unmarked ruler-like element, separate from the game board; at least one circular element, such as a circle marked upon the game board, and markers to mark off a distance along the rectilinear element and an angle within the circular element, such rectilinear and circular element, along with their markers, being utilized by the players to either estimate a distance along the rectilinear element, or an angle within the circle, which distance or angle has been either arbitrarily set by another player, or set by the estimator by picking marked cards, for instance indicating the distance or angle to be set by estimation.

It is a further object of the invention to provide a certain amount of chance as to which player is to play first, and as to what estimating problem he is to perform. Thus, dice may be used to choose an order to perform. Thus, disc may be used to choose an order of play, as well as to indicate the number of spaces a player may move from a starting marked area on a game board to an instructing marked area along the periphery of the board, which indicates the problem or problems he must solve.

It is an object of the invention to provide variations of the game of estimating spatial relationships having varying objects of fun, sport and education.

The mathematical concepts and arithmetic practice that develop from playing this game are not only numerous but range from the very basic to the sophisticated. The players must initially be aware that there are 360° in a circle. By placing the angle within the circle, it soon becomes relatively easy to determine which quadrant the angle lies in. 90°, 180° and 270° are easily estimated.

The fractional parts of a whole, and comparisons of fractional parts, become a constant mental reference. The player soon develops a systematic approach to making an estimate.

Onece a 90° angle can be estimated, it is not too difficult to make a close estimate of a 45° angle. Again, it should not be difficult to estimate one-half the distance between 90° and 180°, or the distance between 180° and 270°, etc.

With some sophistication, an estimate can be made of one-third the distance between 0° and 90° or two-thirds the distance between 0° and 90°. Estimates of one-half of a 45° angle can be closely figured. It soon becoms clear that by careful estimations and comparisons of fractional parts, a player can quite accurately estimate any angle.

The estimation of the distance set on a line works on exactly the same principle. The player is given the fact that the line is a given length which may be 360 millimeters, for instance. One-half of 360, and even one-quarter of 360 become fairly easy to estimate. Once a player decides in which quadrant the distance has been set, he relies on more sophisticated fractional comparisons to make an accurate estimate.

By using millimeters instead of inches, the player begins to familiarize himself with the metric system and begins to compute in centimeters and millimeters.

A player will soon become familiar with what distances actually are in centimeters and millimeters.

A player soon begins to realize that he can make quicker and more accurate estimates in the metric system which is based on 10 equal parts to the centimeter, rather than in inches which are divided into eighths and sixteenths.

In addition to learning how to make a systematic estimation by fractional comparisons to the whole amount and to each other, there is a constant computational practice not only in adding and subtracting of whole numbers, but in adding and subtracting the fractional parts of a quadrant in making an estimation.

Various other more detailed objects and advantages of the invention, such as arise in connection with carrying out the above ideas in a practical embodiment will in part become apparent, and in part by hereafter stated, as the description of the invention proceeds.

Referring to the drawings herein:

FIG. 2 is a composite plan view of rods, which may be used in the game; a ruler, protractor, dice and playing pieces;

FIG. 3 is a top plan view of direction cards for playing the game in a modified form; and FIG. 4 is a plan view of a score sheet used in tallying the players' scores.

Figure 1:
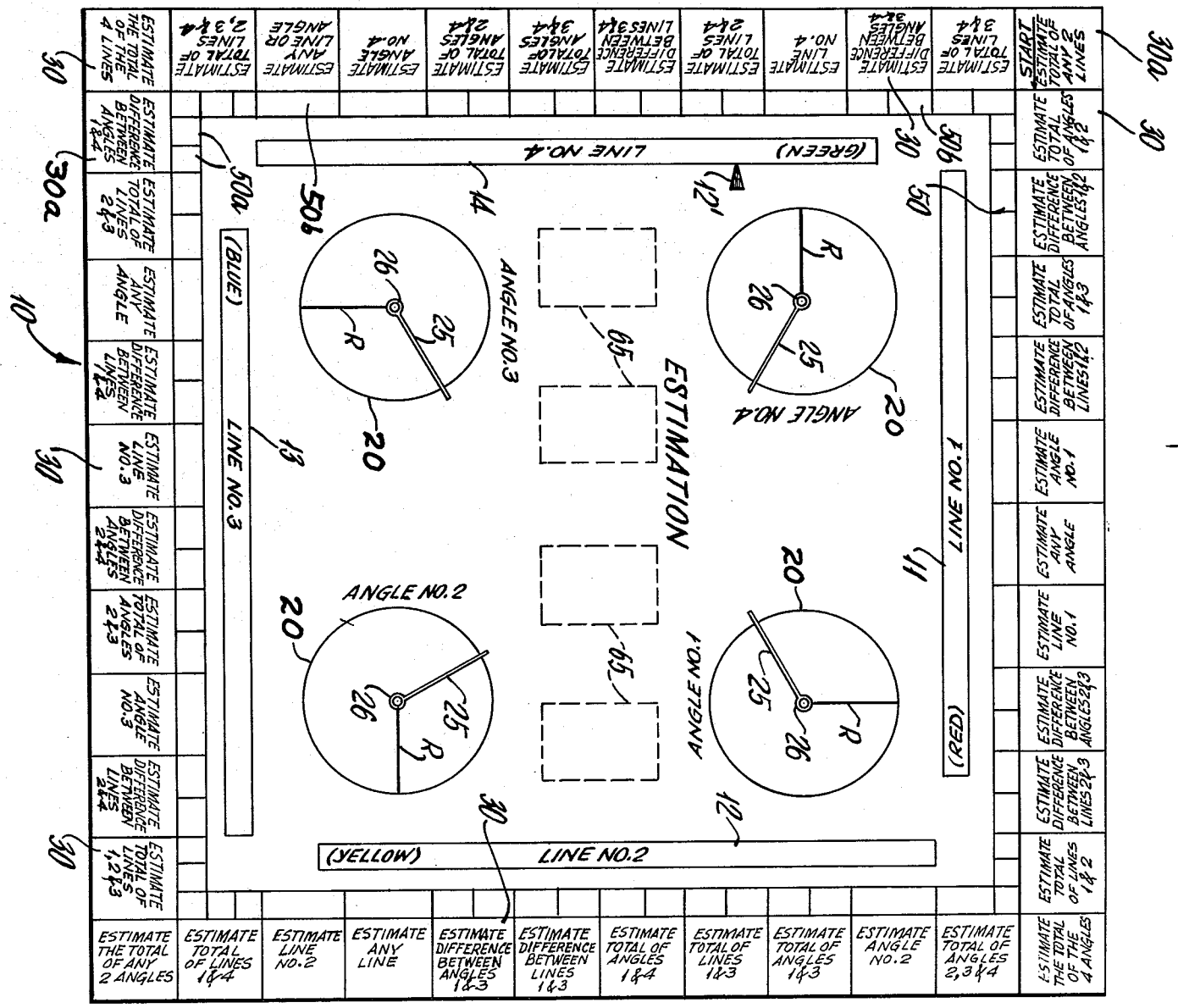
FIG. 1 is a top plan view of a playing board, in accordance with the invention.

The board 10, as shown in FIG. 1, may comprise, as shown, four rectilinear imprintations 11, 12, 13 and 14, which may, of course, be colored differently (yellow, blue, green and red) to correspond with similarly colored player pieces 15 and with similarly colored bars 50 atop boxes 30, to be discussed, and may be marked "Line No. 1", "Line No. 2," etc., as shown.

These rectilinear imprintations 11 – 14 may be used as elements, along which markers 12' may be placed, or they may be outline delineations for separate rectilinear elements 15', having slide markers 16, slidably engaging the elements 15', similar to a slide rule marker.

The game board 10 may also include circular elements 20 imprinted thereon, each including a line R radially emanating from the center thereof, which preferably is on a true vertical plane with the imprinted rectilinear elements 11 – 14.

The centers of the circular elements have pointers 25 attached thereto, be any convenient, conventional means, such as pins or rivets 26, and the pointers are movable about the central pivot.

About the periphery of the game board are series of imprinted boxes 30 which specifically instruct the player whose player piece 15 lands upon them to estimate either totals of or differences between spatial relationships made by the markers along and within the four rectilinear and circular elements.

A corner box 30*a* comprises the START box, where each player must place his player piece 15 at the beginning of the game. The choice as to which player "goes" first may be derived by a throw of the dice. Similarly, a throw of the dice may be used to designate the first player to "set" a marker or markers on a line or lines or a pointer or pointers about a circle or circles.

The peripheral boxes 30 may require a player, when his player piece lands thereon, to estimate the distance between a marker and the end of any line, or to estimate the difference between the markers and ends of lines Nos. 2 and 3, etc. Conveniently, the imprinted indicia for the rectilinear and circular elements, as has been mentioned, may be marked "NO. 1," etc. Thus, similarly, the boxes may require a player to estimate the angle made by the pointer or pointers with the vertical lines of the circular elements.

Situated atop each peripheral box 30 are bar imprintations 50, which may be colored to correspond with the rectilinear and circular elements or which may be colored black or white or any other color not identified with a line or player piece. Thus, the player can see in advance what he may be required to do if his marker piece 15 lands on a particular peripheral box; i.e., he may have more than one estimation to make. This provides anticipation to the game as the player is about to throw the dice. For instance, if the rectangular elements 50*a* comprise red and green bars the player knows, if his marker lands on box 30*a*, that he must estimate the difference between angles Nos. 1 and 4 made by the markers on corresponding circular elements with the respective vertical lines.

The bars above the boxes which do not correspond in color to the rectilinear and circular elements on the board, bar 50*b*, for instance, may be black and, bar 50*b* may be overlie a peripheral box 30 which directs the player to estimate his choice of any one of the settings, either angular or rectilinear.

In all events, a ruler R, preferably marked off in centimeters and a protractor P are used to measure the exact rectilinear and angular relationships by placing the measuring devices on the elements and measuring the position of the slide markers and pointers.

In another embodiment of the invention, indicia, such as four sets of cards, 60, 61, 62 and 63 are offered the players. These cards may be set on blank rectangular imprintations 65 on the board or may be used to play the game without the board but with rectilinear and circular elements and markers with which estimates can be made externally of the board.

The first deck 60 is a deck of 30 cards marked "LINE or ANGLE", having 15 cards with their undersurfaces on faces marked "ANGLE" and 15 marked "LINE." The second deck 61 is a deck of 30 cards marked "HUNDREDS" on their top sides, and on their undersides there are nine cards marked with zeroes, nine cards marked with a one, nine cards marked with a two and three cards marked with 2½.

The third deck 62 of 30 cards is a deck wherein all the cards are marked on their top sides with "TENS". On their undersides, three each are marked with the digits; 1, 2, 3, 4, 5, 6, 7, 8, 9, 0.

The fourth deck 63 is a deck of 30 cards, and all are marked on their top sides with "UNITS" and on their undersides, just as in the third deck, three each of all the digits; 1, 2, 3, 4, 5, 6, 7, 8, 9, 0.

Thus, the player is required to set the angle in the circular element, or set the marker along the rectilinear element, to correspond with the information dictated by the cards he has turned over.

The cards, of course, need not be used, and other indicia, dictating to the player the settings he must establish, may be provided. For instance, the player to his left may call "THE ANGLE WITHIN THE CIRCLE" or "THE DISTANCE ALONG THE RECTILINEAR ELEMENT," to which the markers must be placed by estimation.

In all events, a score is kept for each player by scoring pads, such as shown in FIG. 4. As each play involves estimating as close to the actual spatial relationship as possible, the player with the lower score wins in all events.

It will be understood that the rules of the game and method of play are subject to variations within a wide range, the principal factor being the concept of invention relating to estimating spatial relationships and measuring the accuracy of such estimations within a game format.

As disclosed, there are four separate games, two different games played on the board and two different games played with the cards.

GAME NO. 1

Using the face of the board having the four circles and the four lines on it, this game may be played by from two to six people.

The angle devices and the 360 mm. rod are in corresponding colors to the ones on the board. The players roll the dice to see who goes first and, once the order of turn is established, the first player selects either a rod or an angle and arbitrarily sets any distance or angle he wishes on it and places it in its corresponding place on the board by color.

The second player selects an angle or rod, again makes his settings anywhere he desires and places it in its arbitrary position on the board. This is done until there are four angles and four lines placed on the board.

At this time, each player refers to his score sheet, FIG. 4. Each player now makes the twelve estimates listed on the score pad, i.e., estimates in Column I, the length in millimeters of line 11; the amount of degrees made in a selected circle by a pointer; the next line and angle, etc. The last four estimates are the differences between LINE NO. 1 and ANGLE NO. 1; LINE 2 and ANGLE 2; LINE 3 and ANGLE 3; and LINE 4 and ANGLE 4. A further explanation of this: Assuming the player estimated LINE NO. 1 to be 57 mm. long and the estimated ANGLE NO. 1 to be 136°, he would put their estimated difference at (136–57) which is 79. Once these 12 estimates are made, then score sheets are exchanged to avoid further correcting and the players take turns in making the actual measurements by protractor P and metric ruler R. These actual measurements are then tabulated on the score pad in Column No. 2, under "ACTUAL MEASUREMENTS." Then in Column No. 3, under DIFFERENCE, the difference between the estimates in Column No. 1 and the actual measurement in Column No. 2 is scored.

The total difference is added and that gives each player his score. Obviously, low score wins.

GAME NO. 2

A second way to play this game on the board is by using dice and the path of directions on the outer edge of the board. In this game, one of the players is designated as scorekeeper.

The game begins in the same manner as in the directions for Game No. 1, until the four angles and the four lines have been set and placed in their corresponding places on the board. At this time, rather than immediately making estimates, the players in their turn, roll the dice and with their player pieces 15 follow the path around the board. When a player lands on a set of directions, he will make the estimate that is asked of him. When his estimate is announced to the others, the one player who has been designated as scorekeeper records the estimate. Then the player to the immediate left makes the actual measurement or measurements involved and these are given to the scorekeeper. He then tabulates the difference between the player's estimate and the actual measurement. This becomes that player's first round score. Before the next player rolls the dice, the player to the right of the first player (it can be anyone except the next player to roll the dice) must then readjust any angle or line that has been measured to a new setting, so that all lines and angles are unmeasured before rolling the dice.

When each player has made 12 estimates and these estimates and their differences from the actual are recorded, the 12 differences are added for a final score. Again, low score wins.

This game is more complex than the first in a few ways. First, the element of chance and/or luck is introduced by the dice. Players will be not only making different estimates of different settings, but the directions on the edge of the board vary in degree of difficulty. Some directions ask to make one single estimate, some ask to make two and add their total, or to estimate their difference, and some actually ask for a total of four estimates on the same turn. The errors in each estimate will greatly increase the difference for that one score.

Another factor in this game is that the players are involved in the manipulating of the lines and the angles on a continual basis, i.e., each time an estimate is made, lines and/or angles are reset. This in turn causes more actual measurement of lines and angles.

The good player soon learns to make settings which are more difficult for the others to read, i.e., a setting half-way between 0° and 90° is more readily estimated than a setting one-fifth of the way between 0° and 90°.

GAME NO. 3

This time the four places 65 for the four small decks of cards are used. Only a single circle in the center to place an angle and one area to place a 360 mm. rod are required. From two to six players may play this game. At the outset of the game, each player selects a rod and an angle setting device of matching colors.

The four decks of cards are separately shuffled and placed on their corresponding places on the board.

In the first square is the deck marked "LINE or ANGLE." These cards will, when turned face up, read " < " or "—" or alternatively "Angle" or "Line". There will be 30 cards, 15 of each in this deck.

The other three decks of cards will also have 30 cards in each deck. The second deck will be marked "HUNDREDS" and will reflect the hundreds column of a number when it is drawn. This deck will contain nine zeroes; nine ones, nine twos and three two and one-halfs.

The third deck will be marked "TENS" and will reflect the tens column of a number when it is drawn. This deck will contain three each of the digits: 1, 2, 3, 4, 5, 6, 7, 8, 9 and 0.

The fourth deck will be marked "UNITS" and will reflect the units column of a number when it is drawn. This deck will contain three each of the digits: 1, 2, 3, 4, 5, 6, 7, 8, 9 and 0.

Players may select a card from the units deck to see who goes first. High card goes first.

When the cards of the four decks are shuffled and placed face down, the first player turns over one card from each of the four decks. The first card will state: LINE or ANGLE and the next three cards will be read as a three digit number in either degrees or millimeters. The maximum number in the hundreds column is two and one-half (250) to prevent getting a number over 360, the maximum angle which can be estimated.

The player then, with either his 360 mm. rod or his angle setting device, tries to make a setting that is equal to the reading on the cards. Once he makes a setting and places it on the board, he may no longer correct. That setting is then measured by the player to his immediate left with either a protractor or a metric ruler. The difference between the player's setting and the three digit number on the cards is recorded as the player's score. Each player makes 10 estimates. Then the differences are added for a total score. Low score wins.

GAME NO. 4

This game is very similar to Game No. 3, except it is played without the first deck of cards marked ANGLE and LINE.

The players turn up three cards to get a three digit number from the other three decks and then create both that line in millimeters and that angle in degrees. These are then both measured by the player to the left and the total difference between the player's estimates and the actual measurements are recorded as a score.

Again, after each player has played 10 rounds and has 10 scores, they are totalled. Again, low score wins.

An additional optional rule in both games No. 3 and No. 4 may be that if a player draws a zero in each column, he either may draw again by rule, or, if accepted before the game begins, he can be awarded a perfect score of zero for that round.

While the preferred specific embodiment has been here described, it is to be understood that the invention is not to be limited to the exact constructions, lengths, measurements, mechanism and rules illustrated and described, because various modifications of these details may be provided in putting the invention into practice.

What is claimed is:

1. A game comprising, in combination, at least one rectilinear element devoid of measurement increments, means movable along said element for marking off a distance between the ends thereof, ruler means for measuring said distance, a pair of linear elements movable relative to one another about an axis for forming an angle, protractor means for measuring said angle, scoring means for tabulating the measured distance and angle.

2. The game of claim 1, including means for directing a player to estimate either or both said distance and angle.

3. The game of claim 2, including a playing board, a plurality of indicia imprinted upon said board constituting said means for directing a player to estimate, at least one player piece is provided for chance placement upon any one of said indicia and means are provided for directing a player to place said piece on one of said indicia.

4. The game of claim 3, wherein said rectilinear elements and said pair of linear elements form parts of said board.

5. The game of claim 1, including means directing a player to set said marker at an estimated distance along said element and/or to form an angle with said pair of elements.

6. The game of claim 5, wherein said means for directing a player to set comprise playing cards having directing indicia on their faces.

7. The game of claim 1, including means for directing a player to estimate either or both said distance and angle and including means directing a player to set said marker at an estimated distance along said element and/or to form an angle with said pair of elements.

8. The game of claim 1, wherein said marking means is slideably engaged with said at least one rectilinear element.

9. The game of claim 1, wherein said ruler means include metric increments.

10. A game comprising in combination, at least one rectilinear element devoid of measurement increments, means movable along said element for marking off a distance between the ends thereof and ruler means for measuring said distance.

11. A game comprising, in combination, at least one pair of linear elements movable relative to one another about an axis for forming an angle and protractor means for measuring said angle.

* * * * *